US010953274B2

(12) United States Patent
Hsu

(10) Patent No.: US 10,953,274 B2
(45) Date of Patent: Mar. 23, 2021

(54) EXERCISE DEVICE

(71) Applicant: Cheng-Yang Hsu, Changhua (TW)

(72) Inventor: Cheng-Yang Hsu, Changhua (TW)

( * ) Notice: Subject to any disclaimer, the term of this patent is extended or adjusted under 35 U.S.C. 154(b) by 0 days.

(21) Appl. No.: 16/221,553

(22) Filed: Dec. 16, 2018

(65) Prior Publication Data

US 2019/0329093 A1 Oct. 31, 2019

(30) Foreign Application Priority Data

Apr. 25, 2018 (TW) ..... 107205384

(51) Int. Cl.
*A63B 22/06* (2006.01)
*A63B 21/00* (2006.01)

(52) U.S. Cl.
CPC ..... *A63B 22/0605* (2013.01); *A63B 21/4035* (2015.10); *A63B 2022/0652* (2013.01)

(58) Field of Classification Search
CPC ..... A63B 22/0605; A63B 21/4035; A63B 2022/0652; A63B 1/00; A63B 22/06–0605; A63B 2022/0611–0658; A63B 21/0004–00043; A63B 21/02–0442
See application file for complete search history.

(56) References Cited

U.S. PATENT DOCUMENTS 3,937,461 A * 2/1976 Lew ..... A63B 7/02 482/43
5,071,117 A * 12/1991 Mautner ..... A63B 21/00178 482/57
5,556,361 A * 9/1996 Liao ..... A63B 21/068 482/72
5,672,142 A * 9/1997 Wu ..... A63B 22/0076 482/57
5,800,321 A * 9/1998 Webber ..... A63B 21/00072 482/100
7,150,701 B2 * 12/2006 Lines ..... A63B 21/154 482/102
7,335,141 B2 * 2/2008 Piane, Jr. ..... A63B 21/055 482/101

(Continued)

OTHER PUBLICATIONS

"Sunny Health & Fitness Foldable Semi Recumbent Magnetic Upright Exercise Bike," oldest sale date based on review Nov. 26, 2017, https://www.amazon.com/Sunny-Health-Fitnes-Monitoring-Adjustable/dp/B076C19CDS/ref=cm_cr_arp_d_product_top?ie=UTF8 (Year: 2017).*

*Primary Examiner* — Andrew S Lo

(57) ABSTRACT

An exercise device has a frame member comprising first and second supporting members, a pulling set and a loading bar. The frame member is provided with an upper roller and a lower roller, and a pulling set comprising an elastic line is placed under the first supporting member. Two front pull handles are disposed adjacent to the upper roller, and two rear pull handles are disposed adjacent to the lower roller. Therefore, a user can hold the two front pull handles or the rear pull handles with both hands to pull the elastic line for upper body stretching. The loading bar is connected to an outer tube and an inner tube between the first the supporting member and the second supporting member. The loading bar supports below the seat cushion and increases the load capacity of the frame member, thereby preventing the frame member from deforming.

8 Claims, 9 Drawing Sheets

(56) References Cited

U.S. PATENT DOCUMENTS 7,393,308 B1 * 7/2008 Huang ..... A63B 22/001 482/51
7,422,548 B1 * 9/2008 Teng ..... A63B 21/0051 482/51
7,476,184 B1 * 1/2009 Batca ..... A63B 21/159 482/100
7,654,942 B1 * 2/2010 Batca ..... A63B 23/12 482/99
7,740,563 B2 * 6/2010 Dalebout ..... A63B 21/00072 482/52
7,981,010 B1 * 7/2011 Webber ..... A63B 23/1209 482/96
10,052,516 B1 * 8/2018 Lin ..... A63B 21/4047
D863,465 S * 10/2019 Lentine ..... A63B 69/04 D21/663
2006/0172867 A1 * 8/2006 Lee ..... A63B 22/0012 482/57
2007/0161467 A1 * 7/2007 Lee ..... A63B 69/04 482/57
2008/0119333 A1 * 5/2008 Bowser ..... A63B 21/055 482/62
2008/0214367 A1 * 9/2008 Webber ..... A63B 23/03541 482/95
2009/0239718 A1 * 9/2009 Yamazaki ..... A63B 21/00181 482/57
2010/0210425 A1 * 8/2010 Bowser ..... A63B 21/055 482/62
2011/0118090 A1 * 5/2011 Ellis ..... A63B 21/4035 482/54
2015/0335936 A1 * 11/2015 Shakespeare ..... A63B 21/0084 482/58
2016/0346595 A1 * 12/2016 Dalebout ..... A63B 22/0012
2017/0043202 A1 * 2/2017 Chuang ..... A63B 21/0552
2017/0259111 A1 * 9/2017 Hsieh ..... A63B 22/0605
2017/0291062 A1 * 10/2017 Chang ..... A63B 21/4034
2019/0262655 A1 * 8/2019 Lentine ..... A63B 21/0056
2019/0381350 A1 * 12/2019 I-Heng ..... A63B 21/0083

* cited by examiner

EXERCISE DEVICE

BACKGROUND OF INVENTION

1. Field of Invention

The present invention relates to an exercise device, and more particularly to a spin exercise machine.

2. Description of the Related Art

According to the training functions, the fitness machines are divided into two categories: single functional and multi-functional. For different fitness purposes, there are rowing machines, bodybuilders, treadmills, spin bicycles . . . etc. It is very common to combine two different types of functions into one machine, such as combining of supine press and sit-ups exercises, or a combing chest stretch exercise with bicycle exercise. However, it is not difficult to find out that the above-mentioned conventional structures still have some deficiencies, such as: multi-functional exercise machines will increase the physical volume of the machine due to the complex structure, the price will increase greatly, and different parts cause interference with each other. Therefore, it is not easy to combine more than three fitness functions. In addition, the bicycle machine generally has an X-shaped frame, and the weight of the user greatly enlarged due to conventional design which exceeds the load capacity of the frame member which resulting in deformed and damaged.

Therefore, it is desirable to provide an exercise device to mitigate and/or obviate the aforementioned problems.

SUMMARY OF THE INVENTION

An objective of present invention is to provide an exercise machine, which is capable of improving the above-mention problems.

In order to achieve the above mentioned objective, an exercise machine has a frame member, a pulling set and a loading bar. The frame member is provided with the upper roller and the lower roller, and the pulling set is the elastic rope and placed under the first supporting member. Two front pull handles are placed at the upper roller, and two rear pull handle are placed at the lower roller. Therefore, a user can hold the two front pull handles or the rear pull handles with both hands to pull the elastic rope to achieve the upper body stretching. The loading bar is connected to the outer tube and the inner tube between the first the supporting member and the second supporting member. The loading bar supports below the seat cushion and increases the load capacity of the frame member, thereby preventing the frame member from deformation.

Other objects, advantages, and novel features of invention will become more apparent from the following detailed description when taken in conjunction with the accompanying drawings.

DETAILED DESCRIPTION OF THE PREFERRED EMBODIMENT

Figure 1:
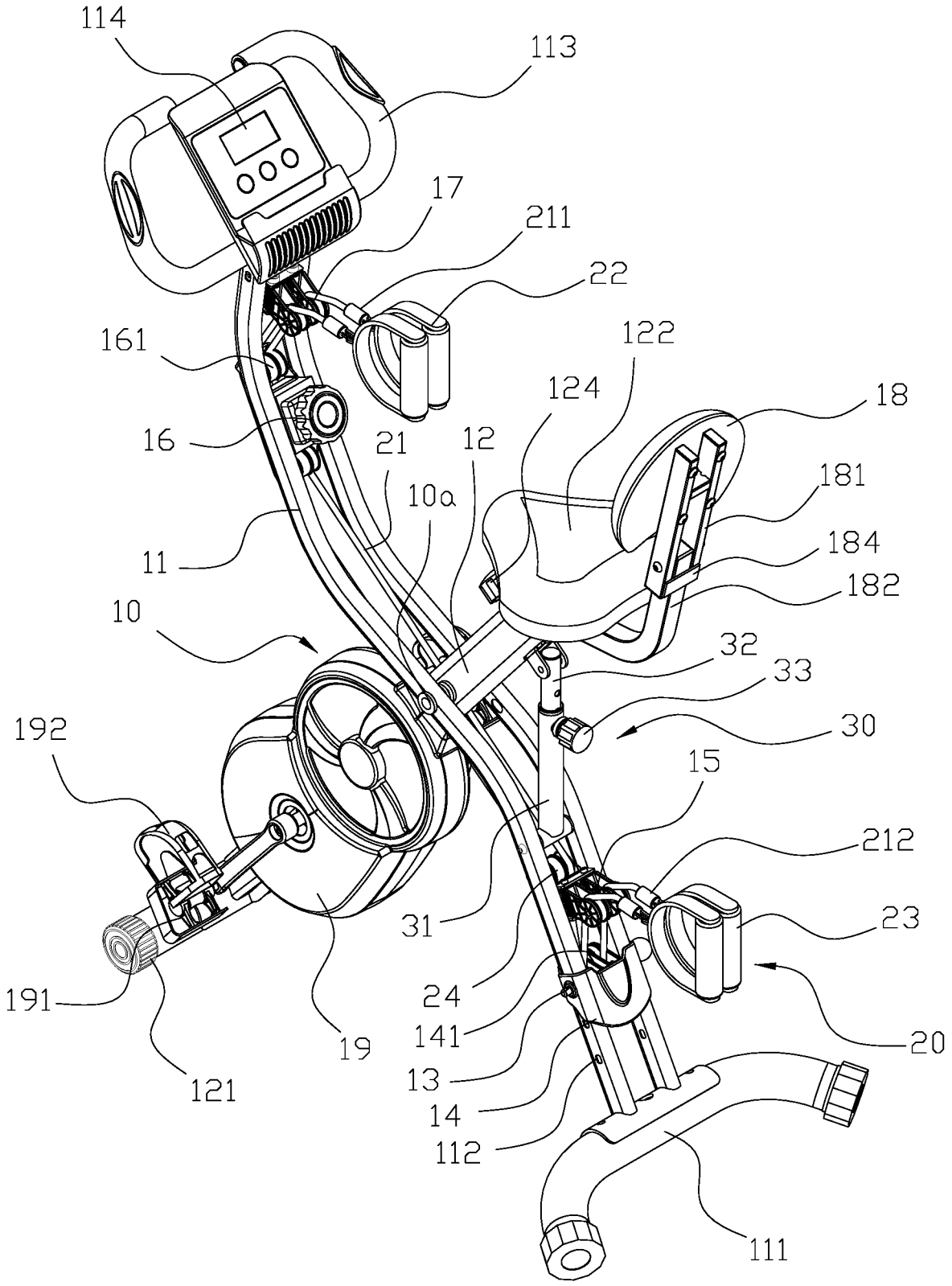
FIG. 1 is a perspective view of a preferred embodiment according to the present invention.

Please refer to FIGS. 1 to 4. An exercise device comprises: a frame member 10, a pulling set 20 and a loading bar 30. The frame member 10 has two parallel first supporting members 11 and a second supporting member 12 crossingly pivoted together at a pivoting point 10*a*, and the second supporting member 12 is sandwiched between the two first supporting members 11. A side supporting member 111, 121 is respectively disposed on a same side of the first supporting member 11 and the second supporting member 12. A plurality of positioning apertures 112 are disposed on the first supporting member 11 between the pivoting point 10*a* and the side supporting member 111, and a positioning bar 13 is configured to connect to an adjusting member 14 at the positioning aperture 112. A pair of positioning rollers 141 are pivoted on the adjusting member 14, and two lower rollers 15 are disposed on the first supporting member 11 between the pivoting point 10*a* and the positioning aperture 112. A handle 113 is disposed on another end of the first supporting member 11 opposite than the side supporting member 111, and the handle 113 is provided with a control panel 114. A connecting member 16 is disposed on the first supporting member 11 between the handle 113 and the pivoting point 10*a*, and two lower rollers 161 are pivoted on the connecting member 16. Two upper rollers 17 are disposed on the first supporting member 11 between the connecting member 16 and the handle 113. Another end of the second supporting member 12 opposite the side supporting member 121 comprises a seat cushion 122, and the seat cushion 122 is attached to a telescoping rod 123 configured for insertion into the second supporting member 23. The second supporting member 12 is provided with an adjusting knob 124 for adjusting a length of the telescoping rod 123. A back support member 18 is disposed on the second supporting member 12 between the pivoting point 10*a* and the seat cushion 122. The back support member 18 comprises two back rods 181, with an arm 182 is pivoted at a middle section of the two back rods 181, and an end of the arm 182 opposite the back support member 18 is provided with a U-shaped socket 183 configured for engaging and locking with the telescoping rod 123. A cross plate 184 is disposed across the two back rods 181 and configured for stopping the arm 182 and the back support member 18, and the back support member 18 is capable of swinging toward to the seat cushion 122. The second supporting member 12 further has a pedal device 19 disposed between the side supporting member 121 and the pivoting point 10*a*, and the pedal device 19 has two foot pads 191 and an anti-slip cover 192. The pedal device 19 has adjustable rotation resistance. The pulling set 20 has two elastic ropes 21, two front pull handles 22, and two rear pull handles 23. An end of each elastic rope 21 has a front hook 211, and another end of the elastic rope 21 has a rear hook 212. Both of the two elastic ropes 21 are disposed under the two first supporting members 11, passing through the upper rollers 17, the lower rollers 161, the positioning rollers 141, and the lower rollers 15, and the two elastic ropes 21 are also disposed on two sides of the second supporting member 12. The front hook 211 of each elastic rope 21 is disposed adjacent the upper roller 17 and connected to the front pull handle 22, and the rear hook 212 of each elastic rope 21 is disposed adjacent the lower roller 15 and connected to the rear pull handle 23. The lower roller 15 further comprises an auxiliary roller 24 pressing the elastic rope 21 and disposed between the lower roller 161 and the positioning roller 141. The loading bar 30 has an outer tube 31, an inner tube 32 and a control member 33. An end of the outer tube 31 is pivoted across the two first supporting members 11 between the pivoting point 10*a* and the lower roller 15, and another end of the outer tube 31 is configured to accept an end of the inner tube 32. The inner tube 32 is provided with a plurality of adjusting apertures 321. The control member 33 is disposed on the outer tube 31 and configured for insertion into one of the adjusting apertures 321. Another end of the inner tube 32 is pivoted between the pivoting point 10*a* and the seat cushion 122 of the second supporting member 12, and the loading bar 30 is disposed between the first supporting member 11 and the second supporting member 12. The loading bar 30 perpendicularly supports the seat cushion 122, and a maximum loading position of the loading bar 30 is perpendicular to the ground. An end of the inner tube 32 adjacent to the outer tube 31 has a storage hole 323, and when the first supporting member 11 and the second supporting member 12 are folded together the control member 33 is stored in the storage hole 323.

The combination of the structures is shown in FIG. 1 to FIG. 4. The frame member 10 has two first supporting members 11 on both sides of the second supporting members 12 and are pivoted at the pivoting point 10*a*, such that the frame member 10 is formed into an X-shaped structure. The side supporting member 111, 121 of the first supporting member 11 and the second supporting member 12 both stand at one end, and the first supporting member 11 is mounted with the adjusting member 14, the lower roller 15, the connecting member 16, the upper roller 17, the handle 113 and the electronic control panel 114 on the side supporting member 111. The adjusting member 14 is secured by placing the positioning bar 13 through the positioning aperture 112. In order to assembler the pulling set 20, the front hook 211 of the elastic rope 21 is first hooked to the front pull handle 22, and then the rear hook 212 of the elastic rope 21 sequentially extends to the upper roller 17, the lower roller 161, the auxiliary roller 24, and the positioning roller 141, and finally the rear hook 212 is passed through the lower roller 15 and attached to the rear pull handle 23. With the front and rear pull handles 22, 23 and the elasticity of the elastic rope 21, the pulling set 20 is limited onto the frame member 10, and the elastic rope 21 is disposed under the two first supporting members 11 and can hide by the both sides of the second supporting member 12. The second supporting member 12 is provided with a pedal device 19 between the side supporting member 121 and the pivoting point 10*a*, and the foot pedal 191 is coupled to both sides of the pedal device 19. The second supporting member 12 is provided with the telescope rod 123 at the opposite end of the side supporting member 121, and the seat cushion 122 is connected by the telescope rod 123. The U-shaped socket 183 of the arm 182 is fixed at the telescope rod 123, and the arm 182 is pivoted onto the back rod 181 of the back support member 18, thereby providing a foldable back to the seat cushion 122. The outer tube 31 of the loading bar 30 is pivotally connected to the first supporting member 11 with a securing rod 311 at a position between the pivoting point 10*a* and the lower roller 15, the inner tube 32 is inserted into the outer tube 31, and the control member 33 is inserted into the adjusting aperture 321. Therefore, the outer tube 31 and the inner tube 32 are mutually retractable, and the inner tube 32 is fixed to the second supporting member 12 with the shaft hole 322, between the pivoting point 10*a* and the seat cushion 122, so that the loading bar 30 can vertically support under the seat cushion 122.

Figure 2:
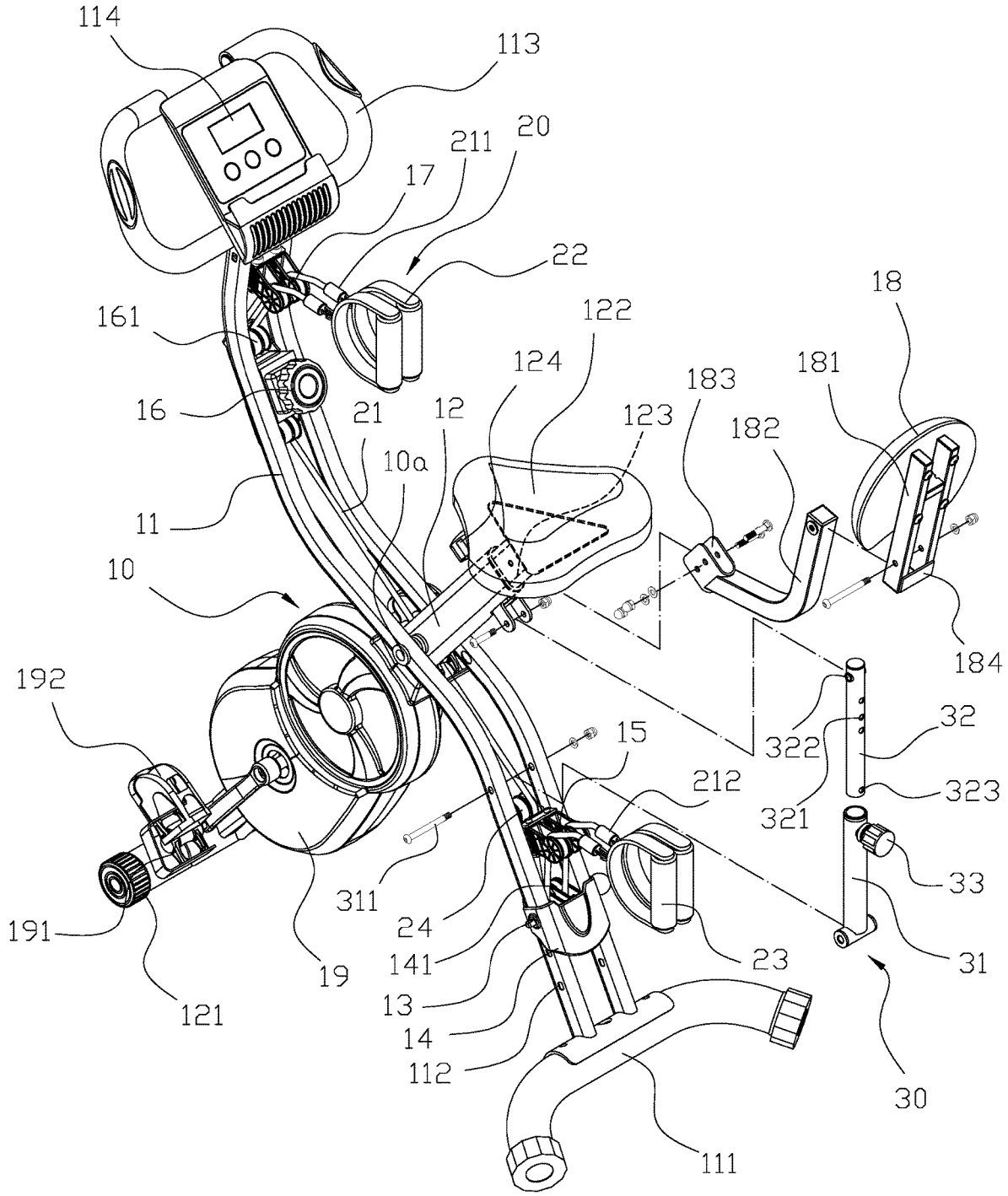
FIG. 2 is a three-dimensional exploded view of the preferred embodiment according to the present invention.
Figure 3:
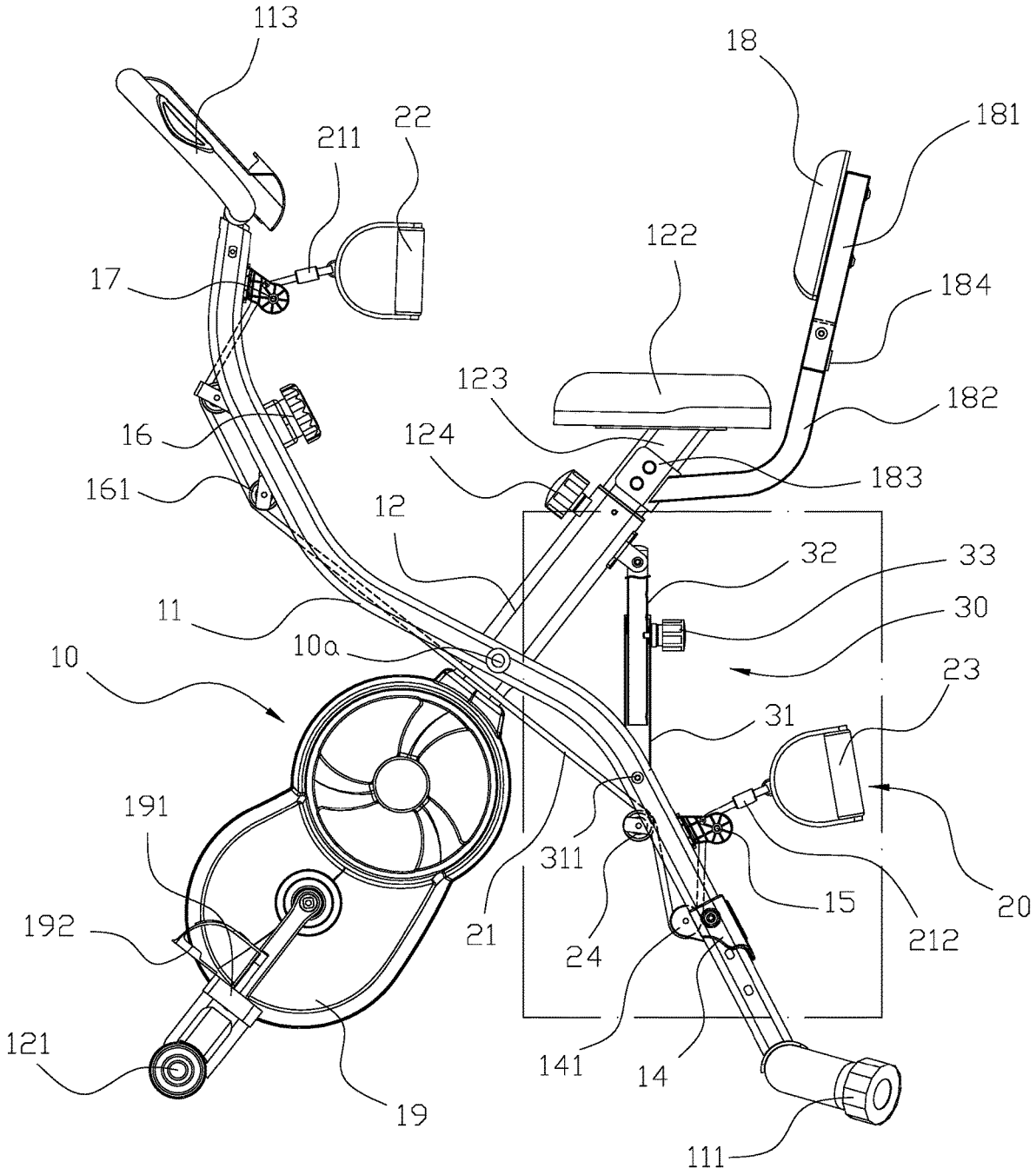
FIG. 3 is a cross-sectional view of the preferred embodiment according to the present invention.
Figure 4:
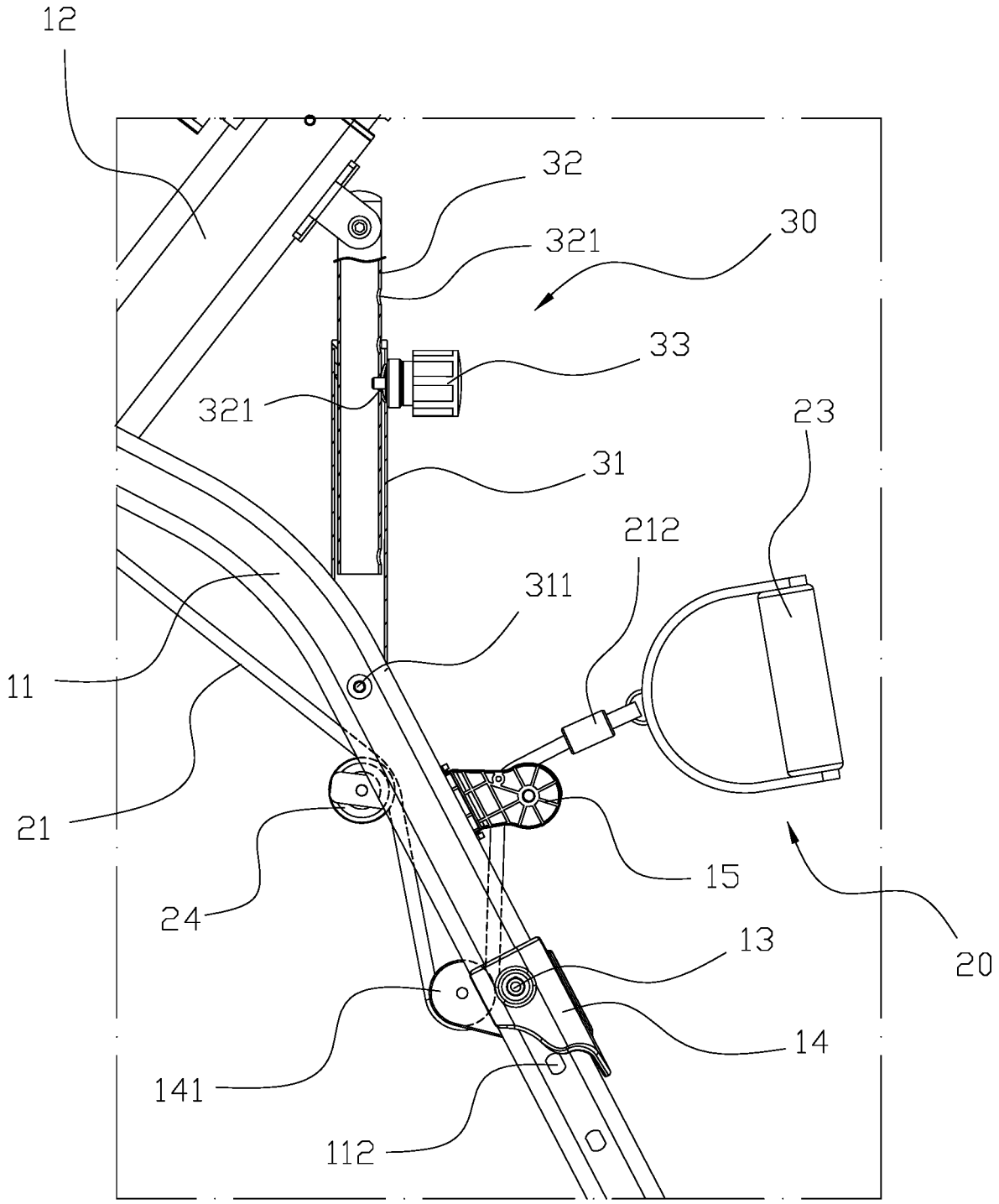
FIG. 4 is a partially enlarged schematic view of the preferred embodiment according to the present invention.
Figure 5:
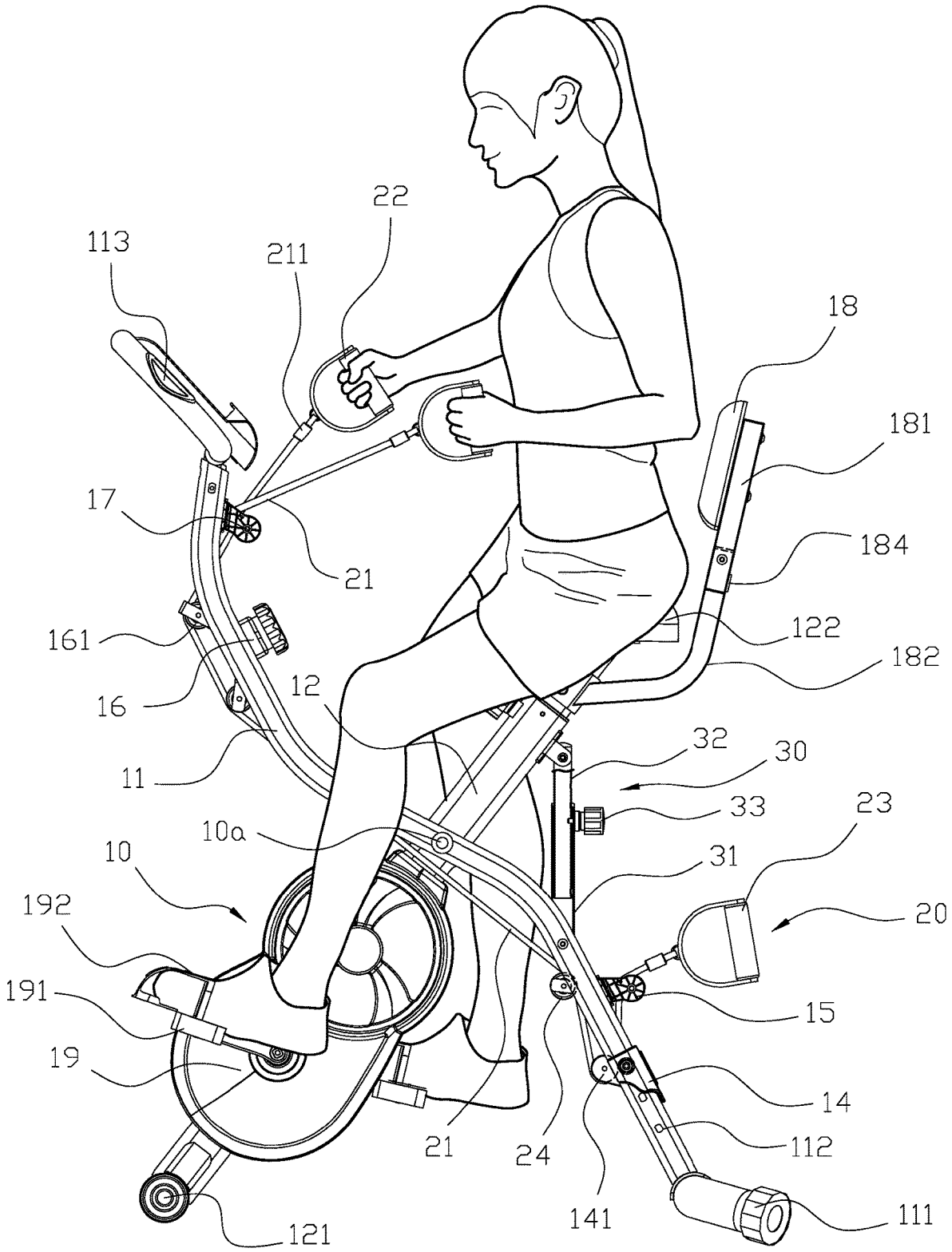
FIG. 5 is a schematic drawing showing state of use of the preferred embodiment according to the present invention.
Figure 6:
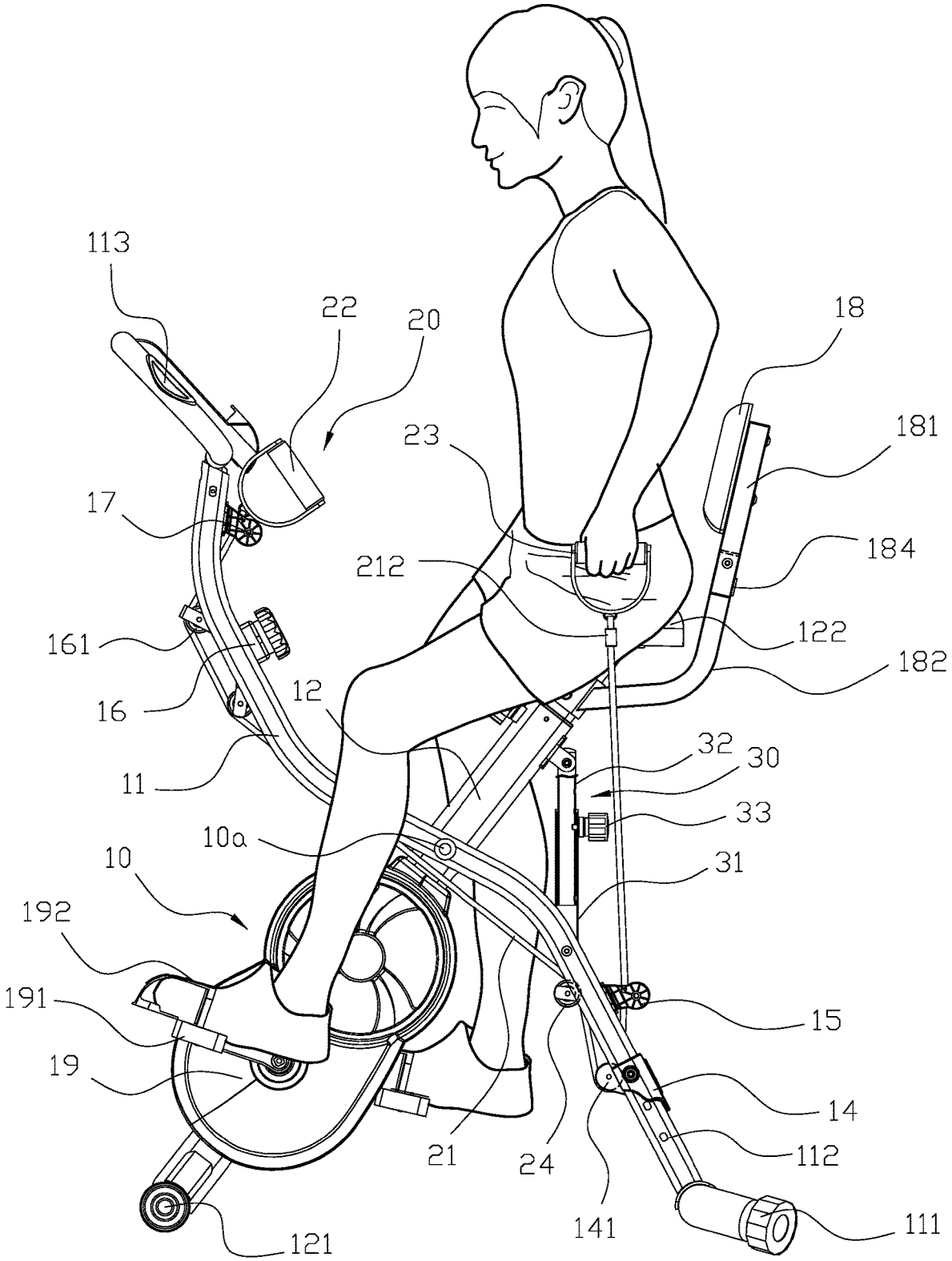
FIG. 6 is another schematic drawing showing state of use of the preferred embodiment according to the present invention.
Figure 7:
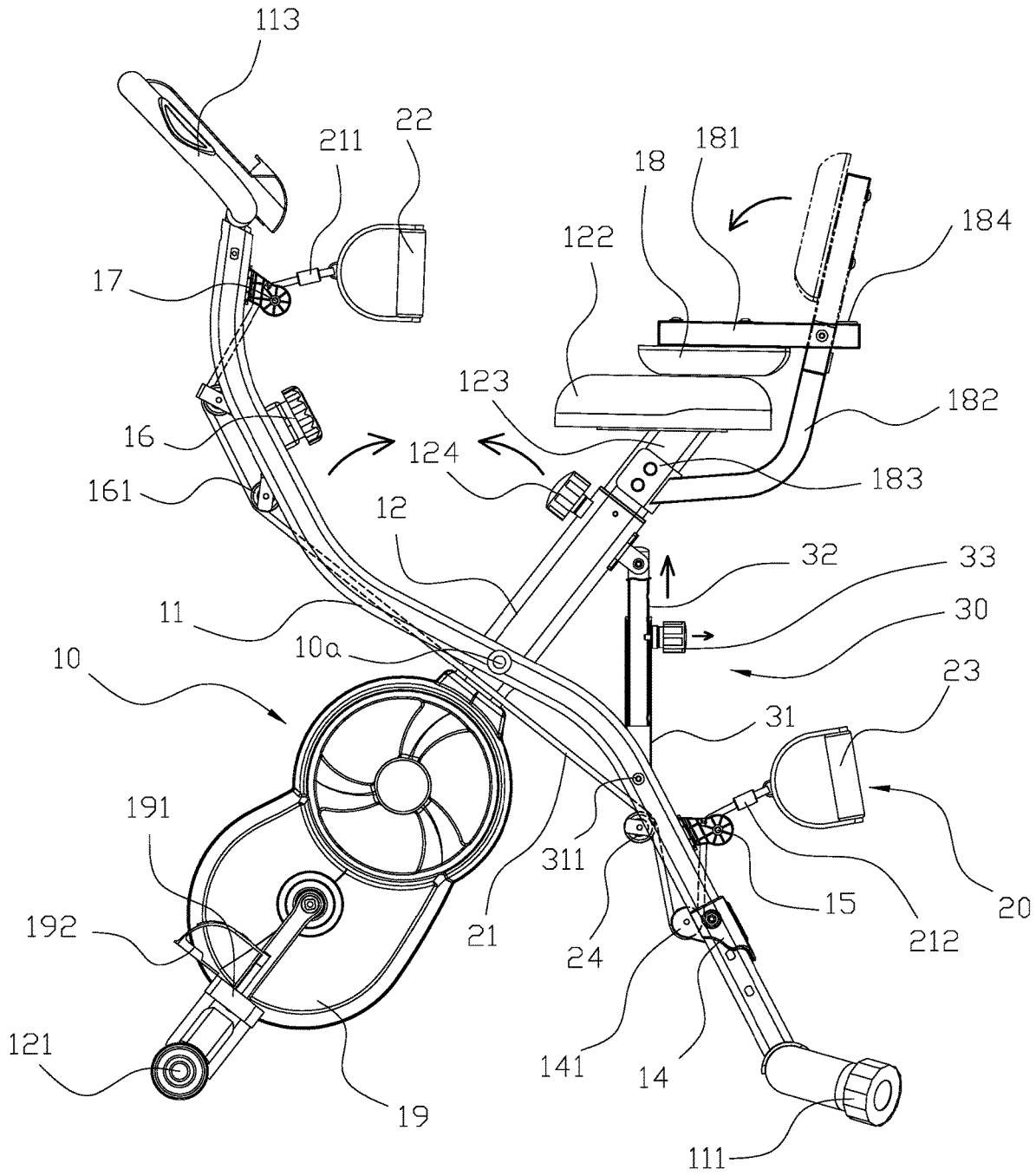
FIG. 7 is a schematic drawing showing the folding operation of the preferred embodiment according to the present invention.
Figure 8:
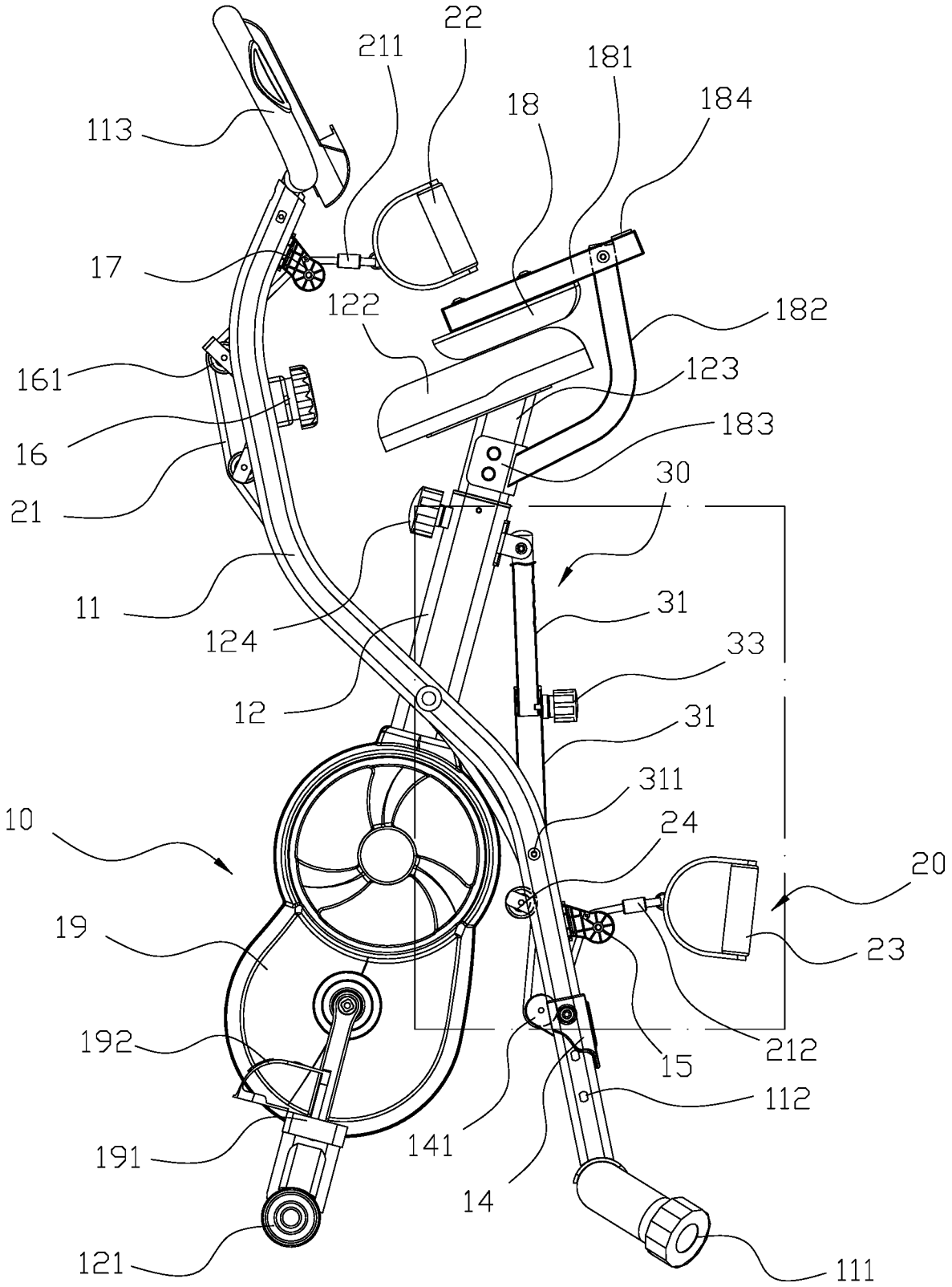
FIG. 8 is a schematic drawing showing the folding operation of the preferred embodiment according to the present invention.
Figure 9:
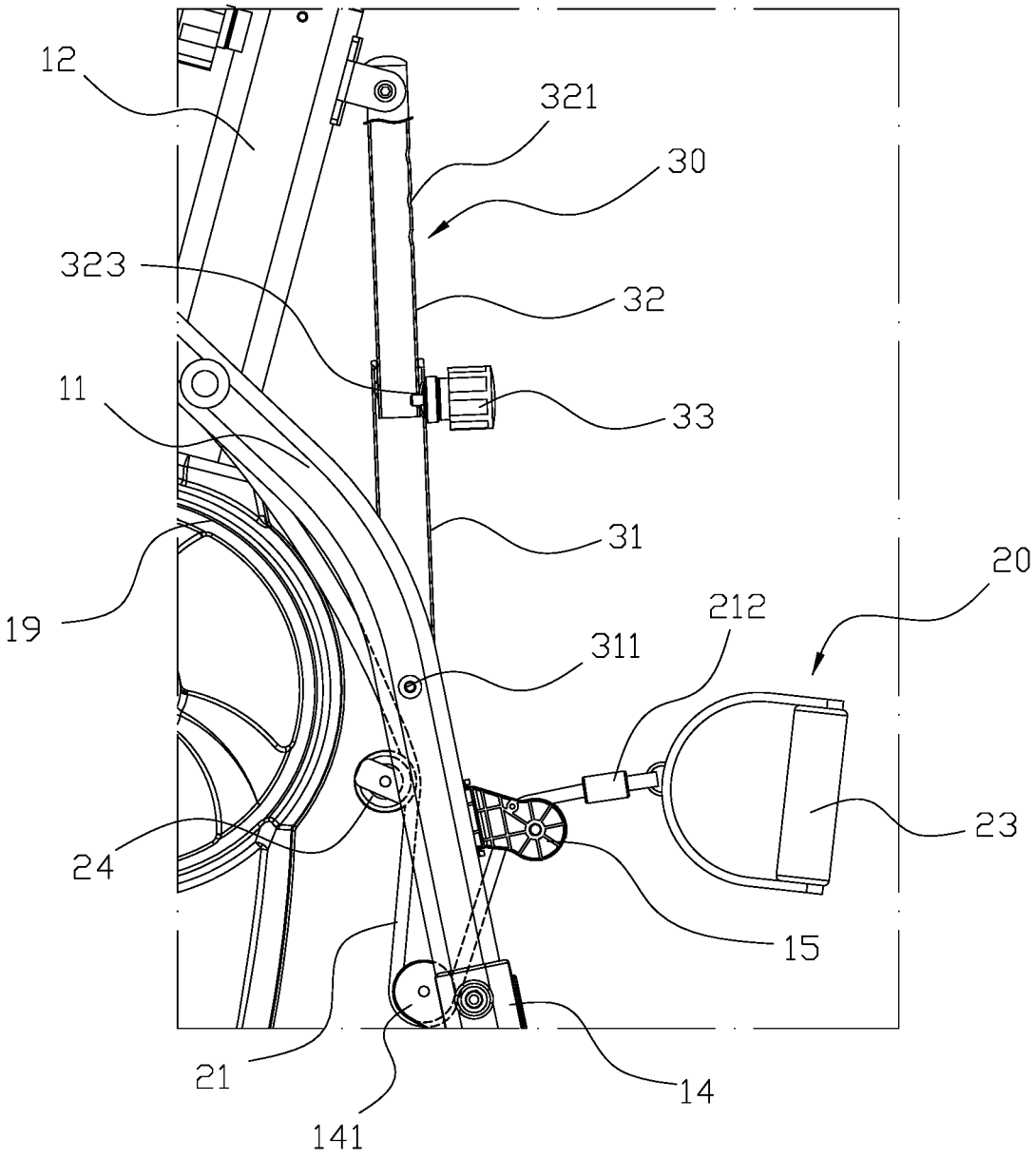
FIG. 9 is a partial enlarged view of the preferred embodiment shown in FIG. 8 according to the present invention.

For the actual use, please refer to FIG. 5 and FIG. 6 with FIG. 2. When a user is operating the machine for exercise, the user can sit on the seat cushion 122 and hold the handles 113 with both hands. The two feet of the user step on the foot pedals 191 of the pedal device 19, so that the foot is sleeved on the anti-slip sleeve 192, thereby achieving a fitness purpose like riding a bicycle. Alternatively, the user can hold the two front pull handles 22 with both hands and pull on the elastic rope 21 and receive a resistance provided by the rear pull handle 23 of the elastic rope 21 against the lower roller 15, which achieves the upper body front and rear stretching effect. Reversely, the two rear pull handles 23 can also be pulled by both hands to stretch the elastic rope 21, and the front pull handles 22 at another end of the elastic rope 21 against the upper roller 17 provide resistance, which achieves the upper body up and down stretching effect. When the user needs to adjust the elasticity of the pulling set 20, the positioning bar 13 can be removed from the positioning aperture 112 of the first supporting member 11 to free the adjusting member 14 and then a different positioning aperture 112 is selected for the positioning bar 13 to secure the adjusting member 14 which cab change the tightness of the elastic rope 21. Another major benefit of the present invention, please refer to FIGS. 2, 3 and 4. When the user is sitting on the seat cushion 122, and his or her weight completely load on the seat cushion 122, and the X-shaped frame member 10 bears a shearing force like a scissors at the pivoting point 10*a*. The structure, is supported between the first supporting member 11 and the second supporting member 12 by the loading bar 30, and the control member 33 of the outer tube 31 engages with the adjusting aperture 321 of the inner tube 32 to provide flexible lengths and fixation. Therefore, the operating height can be adjusted according to the user's needs. The loading bar 30 supports below the seat cushion 122 and increases the load capacity of the frame member 10, thereby preventing the frame member 10 from deformation. Another main function of this present invention, as shown in FIGS. 7, 8, and 9. In order to fold the frame member 10, the control member 33 of the loading bar 30 is moved from the adjusting aperture 321, then the first supporting member 11 and the second supporting member 12 are collected together, and the control member 31 of the outer tube 33 is inserted in the storage hole 323 of the inner tube 32 for a locking effect.

Although the present invention has been explained in relation to its preferred embodiment, it is to be understood that many other possible modifications and variations can be made without departing from the spirit and scope of invention as hereinafter claimed.

What is claimed is:

1. An exercise device comprising:

a frame member having two parallel first supporting members and a second supporting member pivoted together at a pivoting point, the second supporting member sandwiched between the two first supporting members, the first supporting members having a first side and an opposing second side;

a first side supporting member disposed on a same end of the first supporting members and a second side supporting member disposed on an end of the second supporting member;

a plurality of positioning apertures disposed in the first supporting members between the pivoting point and the first side supporting member of the first supporting members, a positioning bar configured to connect to an adjusting member at a selected one of the positioning apertures;

a pair of positioning rollers rotatably connected to the adjusting member and disposed on the second side of the first supporting members;

two first lower rollers connected to the first supporting members between the pivoting point and the positioning rollers and disposed on the first side of the first supporting members;

a handle disposed on another end of the first supporting members opposite the first side supporting member of the first supporting members;

a connecting member disposed on the first supporting members between the handle and the pivoting point;

two second lower rollers rotatably connected to the connecting member;

two upper rollers connected to the first supporting members between the connecting member and the handle and disposed on the first side of the first supporting members;

another end of the second supporting member opposite the second side supporting member of the second supporting member comprising a seat cushion;

a back support member disposed on the second supporting member between the pivoting point and the seat cushion;

a pulling set having two elastic lines, two front pull handles, and two rear pull handles;

an end of each elastic line having a front hook, and another end of the elastic line having a rear hook, both of the two elastic lines respectively passing under the two first supporting members on the second side of the first supporting members and passing over the two upper rollers, the two first lower rollers connected to the connecting member, the pair of positioning rollers, and the two second lower rollers connected to the first supporting members;

the two elastic lines respectively disposed on two lateral sides of the second supporting member;

the front hook of each elastic line disposed adjacent to the respective upper roller and connected to the respective front pull handle, and the rear hook of each elastic line disposed adjacent the respective first lower roller connected to the first supporting members and connected to the rear pull handle; and a loading bar having an outer tube, an inner tube and a control member, an end of the outer tube pivotably connected to the two first supporting members between the pivoting point and the two first lower rollers connected to the first supporting members, another end of the outer tube configured to accept an end of the inner tube, the inner tube comprising a plurality of adjusting apertures, the control member disposed on the outer tube and configured for insertion into a selected one of the adjusting apertures, another end of the inner tube pivoted between the pivoting point and the seat cushion of the second supporting member, the loading bar disposed between the first supporting members and the second supporting member;

wherein the first lower rollers connected to the first supporting members further comprise auxiliary rollers pressing the elastic lines and disposed on the second side of the first supporting members adjacent and opposite to the first lower rollers, and the auxiliary rollers are disposed between the pivoting point and the positioning rollers and rotatably connected to the first supporting members such that the elastic lines passing the auxiliary rollers, the positioning rollers and the first lower rollers form a concave shape.

2. The exercise device as claimed in claim 1, wherein the seat cushion is attached to a telescoping rod configured for insertion into the second supporting member, and the second supporting member is provided with an adjusting knob for adjusting a length of the telescoping rod.

3. The exercise device as claimed in claim 2, wherein the back support member comprises two back rods, an arm pivoted at a middle section of the two back rods, and an end of the arm opposite the back support member is provided with a U-shaped socket configured for being engaged and locked with the telescoping rod.

4. The exercise device as claimed in claim 3, wherein a cross plate is disposed across the two back rods and configured for stopping the arm and the back support member, and the back support member is capable of swinging toward to the seat cushion.

5. The exercise device as claimed in claim 1, wherein the loading bar perpendicularly supports the seat cushion, and a loading position of the loading bar is perpendicular to the ground.

6. The exercise device as claimed in claim 1, wherein the handle further comprises an electronic control panel.

7. The exercise device as claimed in claim 1, wherein the second supporting member further has a pedal device disposed between the side supporting members and the pivoting point, and the pedal device has two foot pads and an anti-slip cover.

8. The exercise device as claimed in claim 1, wherein an end of the inner tube adjacent to the outer tube has a storage hole, and when the first supporting member and the second supporting member are folded together the control member is stored in the storage hole.

* * * * *